US007435030B2

(12) United States Patent
Atterbury

(10) Patent No.: US 7,435,030 B2
(45) Date of Patent: Oct. 14, 2008

(54) SELF-CLEANING PAINT ROLLER

(76) Inventor: Thomas W. Atterbury, P.O. Box 940633, Plano, TX (US) 75094

( * ) Notice: Subject to any disclaimer, the term of this patent is extended or adjusted under 35 U.S.C. 154(b) by 475 days.

(21) Appl. No.: 11/096,658

(22) Filed: Apr. 1, 2005

(65) Prior Publication Data

US 2006/0222448 A1 Oct. 5, 2006

(51) Int. Cl.
*B43M 11/02* (2006.01)

(52) U.S. Cl. ..... 401/219; 401/208

(58) Field of Classification Search ..... 401/208, 401/218, 219, 220; 16/406, 426, 427; 134/138
See application file for complete search history.

(56) References Cited

U.S. PATENT DOCUMENTS

| | | | | |
|---|---|---|---|---|
| 2,831,488 | A | | 4/1958 | Anderson |
| 3,037,516 | A | | 6/1962 | Leach |
| 3,075,534 | A | | 1/1963 | Habostad |
| 3,126,899 | A | | 3/1964 | Caywood |
| 3,139,891 | A | | 7/1964 | Faustman |
| 3,422,828 | A | | 1/1969 | Dommer |
| 3,428,060 | A | | 2/1969 | Spivey |
| 4,222,678 | A | * | 9/1980 | Miller ..... 401/218 |
| 4,402,333 | A | | 9/1983 | Frizzell et al. |
| 4,667,363 | A | * | 5/1987 | Calvert ..... 15/248.2 |
| 4,832,066 | A | | 5/1989 | Shipman |
| 5,005,598 | A | | 4/1991 | Hodgdon |
| 5,050,626 | A | | 9/1991 | Brockage et al. |
| 5,163,459 | A | | 11/1992 | Bailey |
| D340,327 | S | | 10/1993 | Alderete |
| 5,288,161 | A | | 2/1994 | Graves et al. |
| 5,363,869 | A | | 11/1994 | McDowell |
| 5,402,808 | A | | 4/1995 | Wallis et al. |
| 5,413,133 | A | | 5/1995 | Russell |
| 5,487,399 | A | | 1/1996 | Hannah |
| 5,614,021 | A | * | 3/1997 | Catlin ..... 118/258 |
| 5,626,158 | A | | 5/1997 | Gratopp |
| 5,651,381 | A | | 7/1997 | Balouchian |
| 5,839,459 | A | | 11/1998 | Bisby |
| 5,966,902 | A | | 10/1999 | Korycki |
| 6,408,862 | B1 | | 6/2002 | van Rooyen |
| 6,874,201 | B2 | * | 4/2005 | Ta et al. ..... 16/429 |

* cited by examiner

*Primary Examiner*—David J Walczak
(74) *Attorney, Agent, or Firm*—Wilson Daniel Swayze, Jr.

(57) ABSTRACT

A self-cleaning paint roller has a handle, a frame for carrying a roller sleeve attached to the handle, and a cleaning portion for cleaning a roller sleeve carried by the frame.

16 Claims, 10 Drawing Sheets

SELF-CLEANING PAINT ROLLER

BACKGROUND OF THE INVENTION

1. Field of the Invention

The present invention relates to paint rollers and to the cleaning of paint roller sleeves.

2. Description of Related Art

Conventional paint rollers typically comprise a handle, a support frame attached to the handle, a roller rotatably carried by the frame. The roller is adapted to releasably receive a roller sleeve for applying paint to a surface. Although with some paint rollers the roller and the roller sleeve form a single component, most paint rollers are designed for use with removable roller sleeves. After using a paint roller, it is often desirable to clean the roller sleeve so that it can be used again. This is particularly true for high-end roller sleeves made of lamb's wool that are intended to be reused again and again.

There are many ways to clean roller sleeves; however, most methods fall into one of three categories: (1) removing the roller sleeve from the roller; (2) inserting the frame, roller, and roller sleeve into a separate cleaning apparatus; and (3) attaching a cleaning apparatus to the frame, roller, and/or roller sleeve. Although these types of cleaning methods have some advantages, there are significant disadvantages associated with each method. If the paint is allowed to dry on the roller sleeve, if all of the paint is not removed from the roller sleeve, or if the roller sleeve is not properly cleaned soon after each use, the roller sleeve must be discarded.

With regard to the first method of cleaning roller sleeves, the main disadvantage is that the roller sleeve must be removed from the roller, which is a time consuming and messy processes. There are many tools and machines currently available for cleaning a roller sleeve once it is removed from the roller. For example, U.S. Pat. No. 5,487,399 issued to Hannah discloses a hollow tubular housing having a freely rotatable support frame for holding a roller sleeve while the roller sleeve is cleansed. The Hannah system is inconvenient because a user must first handle the paint-filled roller sleeve to insert it into the housing.

With regard to the second method of cleaning roller sleeves, the main disadvantage is that the cleaning device is a separate apparatus that must be stored, cleaned, transported, and made available at the job location. For example, U.S. Pat. No. 6,408,862 issued on van Rooyen discloses a centrifugal roller sleeve cleaner having a cylindrical housing into which a portion of the frame, roller, and roller sleeve are inserted for cleaning. This system is inconvenient because the cleaner is a separate and distinct tool from the paint roller. The user must maintain the cleaning apparatus separately and transport it along with the paint rollers to the job location. If the van Rooyen system is inadvertently left away from the painting location where the paint-filled roller sleeves need to be cleaned, the user must either transport the paint-filled roller sleeves to the cleaning device or forego cleaning the applicators. This delay in cleaning the roller sleeve is problematic, because the roller sleeves become permanently damaged if the paint is not removed before the paint is allowed to dry.

With regard to the third method of cleaning roller sleeves, the main disadvantage is that the user must handle the paint-filled roller sleeve and the cleaning shield. These methods typically involve inserting a portion of the frame, the roller, and the roller sleeve into an attachable cleaning structure, so that the roller sleeve can be cleaned with an ordinary water hose. For example, U.S. Pat. No. 3,139,891 issued to Faustman discloses a cleaning structure that attaches to a paint roller to provide some shielding from paint, water, and other matter slung from the applicator as the applicator is cleaned. The Faustman device is inconvenient, because the user must handle both the paint-filled roller sleeve, the attached cleaning structure, and a water hose to implement the system. Therefore, the user is placed in very close proximity to the cleaning structure and is very likely to get sprayed with paint and water.

In addition to the above described disadvantages, all of the above methods of cleaning roller sleeves further share a number of additional disadvantages. One disadvantage in common to all of the above methods is that none of them are designed to reduce water and cleaning solution consumption. The above methods of cleaning roller sleeves typically use much more water and/or cleaning solution to clean the sleeve than truly necessary. For example, it is not uncommon for a painter to use fifteen gallons or more of water and/or cleaning solution while cleaning a single roller sleeve. Further, the above methods of cleaning roller sleeves are designed for use after the painting process has concluded. The above methods of cleaning roller sleeves are not well suited for cleaning roller sleeves quickly and for the purpose of using the roller sleeves again during the same painting process. The above methods of cleaning roller sleeves typically take long periods of time to fully clean the roller sleeves.

For example, the above methods are not well suited for multiple quick cleaning of the roller sleeves in some of the above methods because the roller sleeve must be removed from the paint roller and placed within a separate cleaning mechanism, taking additional time. Again, where the roller sleeve and frame must be inserted into a separate apparatus for cleaning, the paint roller may need to be transported to the location of the cleaning apparatus, taking additional time.

Another disadvantage shared by all of the above methods for cleaning roller sleeves is that they include complicated steps and require training to use the cleaning devices. For example, where a roller sleeve must be removed from the paint roller and inserted into a cleaning apparatus, the user must be trained on how to properly remove the roller sleeve, how to insert the sleeve into the cleaning apparatus, how to activate the cleaning process, how to remove the sleeve from the cleaning device, and how to reattach the sleeve to the paint roller. Many of the steps above are difficult and cost the user additional time.

Although the foregoing methods represent great strides in the area of paint roller cleaners, considerable shortcomings remain.

SUMMARY OF THE INVENTION

There is a need for a self-cleaning paint roller system and method.

Therefore, it is an object of the present invention to provide a self-cleaning paint roller system and method.

This object is achieved by providing a self-cleaning paint roller system having a handle portion, a frame, a roller carrier rotatably carried by the roller for releasably receiving a roller sleeve, and an integral means for cleaning the roller sleeve without having to remove the roller sleeve from the roller carrier.

The present invention provides significant advantages, including: (1) combining a paint roller and a cleaning apparatus into a single device; (2) drastically reducing the time spent cleaning roller sleeves; (3) providing a system that allows a user to quickly and easily paint with one color, clean the roller sleeve, and immediately begin painting with another color with the same roller sleeve, without having to remove the roller sleeve from the roller; (4) providing a quick and easy system for cleaning roller sleeves for both conventional, non-self cleaning paint rollers and self-cleaning paint rollers; and (5) conserving water and/or cleaning solution use during the cleaning process.

Further objects and advantages of this invention will become apparent from a consideration of the drawings and ensuing description.

BRIEF DESCRIPTION OF THE DRAWINGS

For a more complete understanding of the present invention, including its features and advantages, reference is now made to the detailed description of the invention taken in conjunction with the accompanying drawings, in which like numerals identify like parts, and in which.

DETAILED DESCRIPTION OF THE PREFERRED EMBODIMENT

Figure 1A:
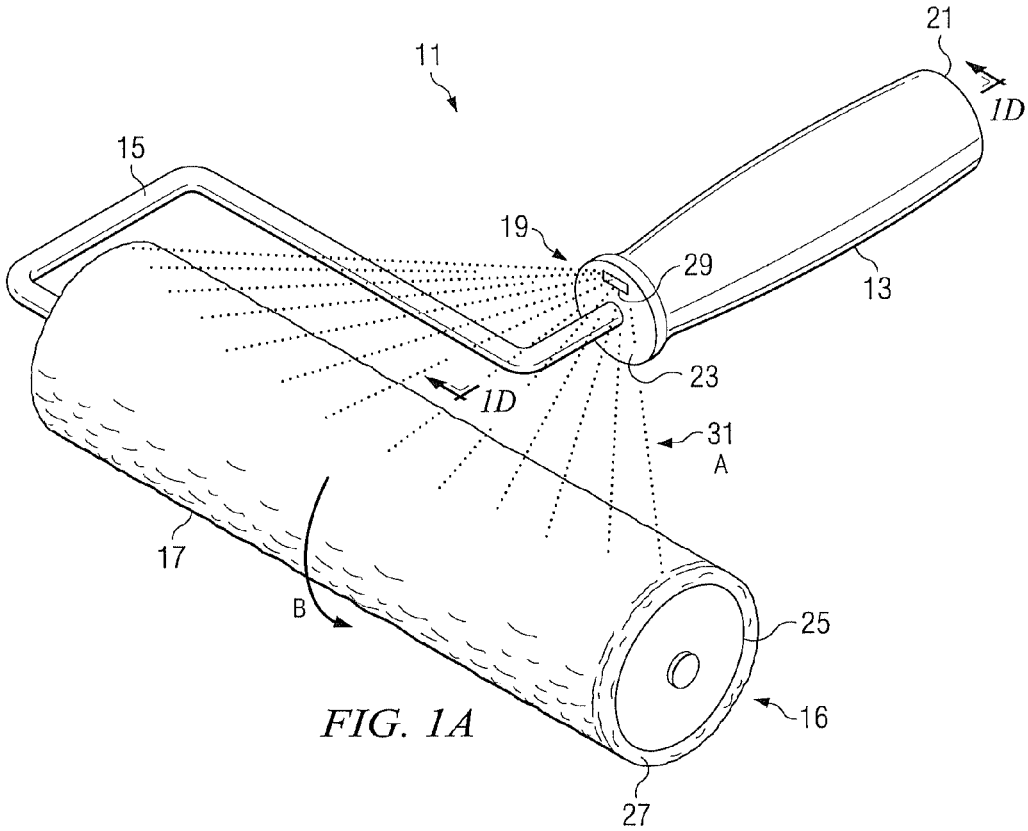
FIG. 1A is a perspective view of the preferred embodiment of a self-cleaning paint roller assembly according to the present invention.
Figure 1B:
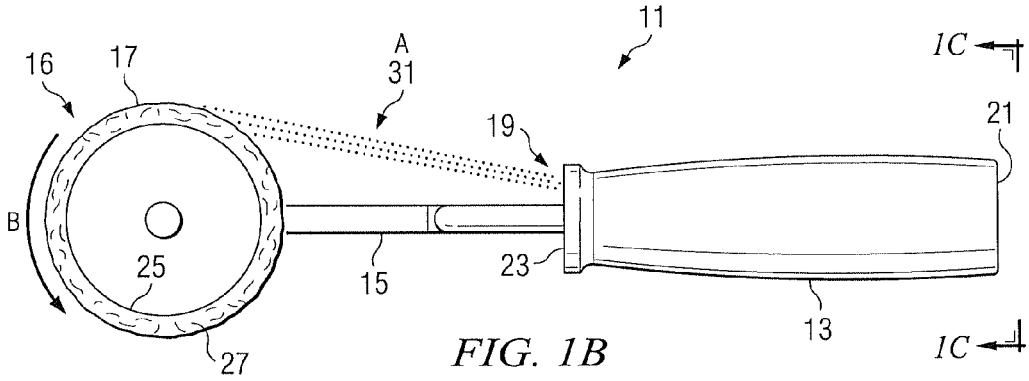
FIG. 1B is an side view of the self-cleaning paint roller assembly of FIG. 1A.
Figure 1C:
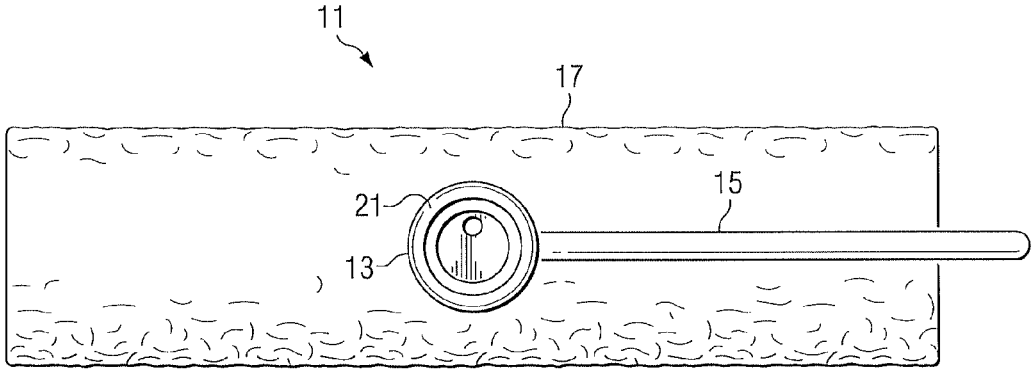
FIG. 1C is an end view of the self-cleaning paint roller assembly of FIG. 1A.

Referring now to FIGS. 1A-1D in the drawings, the preferred embodiment of a self-cleaning paint roller assembly 11 according to the present invention is illustrated. Paint roller assembly 11 preferably comprises a handle 13, a frame 15 coupled to handle 13, a roller 16 rotatably carried by frame 15, and an integral cleaning means 19. Handle 13 has a proximal end 21 and a distal end 23. Although handle 13 is illustrated as a solid grippable elongate member, it will be appreciated that handle 13 may be alternatively be shaped and configured. Roller 16 is adapted to slidingly receive a roller sleeve 17 that is adapted to receive and distribute paint. Roller 16 may include a means for latching and/or centering roller sleeve 17. When assembled onto paint roller assembly 11, roller sleeve 17 is free to rotate about a portion of frame 15. Although frame 15 is shown bent or angled such that roller 16 is substantially transverse to handle 13, it should be understood that frame 15 may alternatively be configured to carry roller sleeve 17 in any other suitable orientation with respect to handle 13.

Figure 2A:
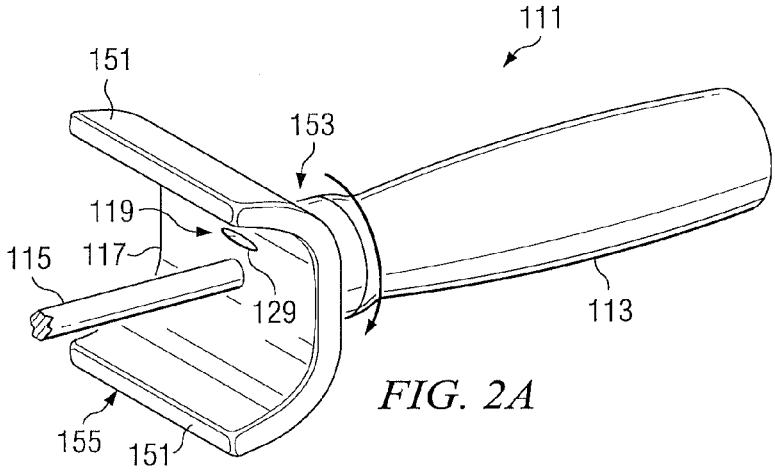
FIG. 2A is a perspective view of an alternate embodiment of a self-cleaning paint roller assembly according to the present invention.
Figure 2B:
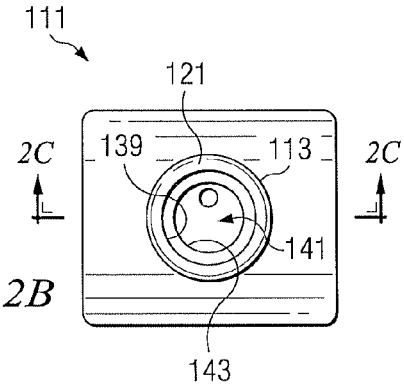
FIG. 2B is a top view of the self-cleaning paint roller assembly of FIG. 2A.
Figure 2C:
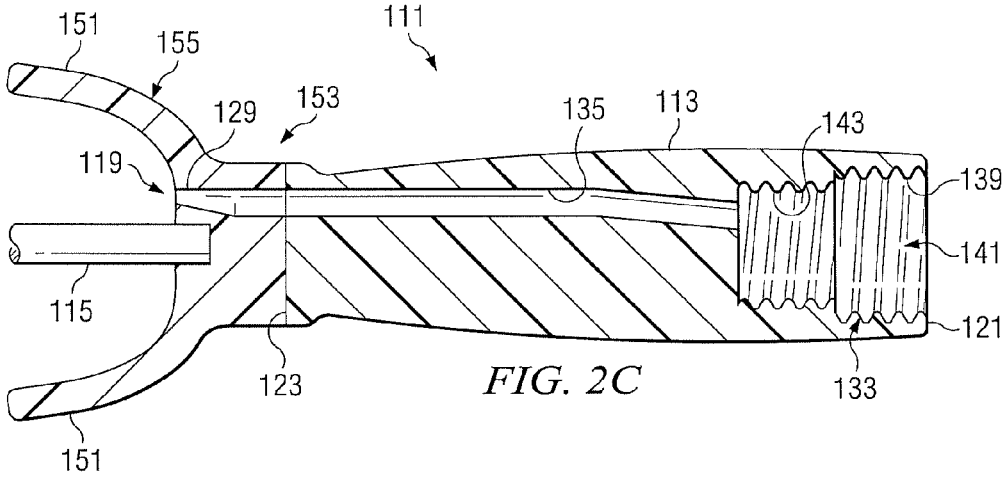
FIG. 2C is a cross-sectional view of the self-cleaning paint roller assembly of FIG. 2A taken at 2C-2C shown with a rotatable head in an "on" position.
Figure 2D:
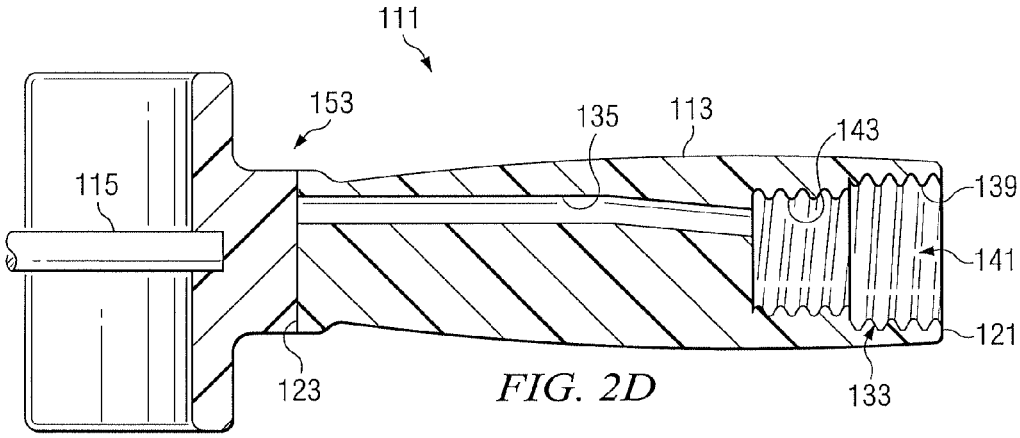
FIG. 2D is a cross-sectional view of the self-cleaning paint roller assembly of FIG. 2A taken at II-II shown with the rotatable head in an "off" position.

Handle 13 is preferably constructed of plastic, and frame 15 is preferably constructed of metal. Roller sleeve 17 is made of conventional materials and includes a rigid internal core 25 and a fibrous external nap 27. Nap 27 may also be configured of other textured materials and may be constructed of wool, synthetic fibers, foam, or any other suitable material. Furthermore, although nap 27 is illustrated has having a regular smooth outer diameter, nap 27 may comprise a variety of features which may form an irregular or patterned outer surface of inner core 25. It should be appreciated that handle 13, frame 15, and roller 16 may substantially vary in shape, size, material, and means of construction without deviation from the present invention. Handle 13 may include flanges, such as flanges 151 (see FIG. 2A), for hanging paint roller assembly 11 on a bucket (not shown).

Cleaning means 19 preferably comprises a nozzle 29 adapted to positively emit fluid onto roller sleeve 17, once roller sleeve 17 has been installed onto roller 16. More specifically, nozzle 29 is preferably shaped and configured to emit a fanned fluid spray 31 as denoted as region A in FIG. 1A, such as by having a rectangular, oblong, or elongated cross-sectional area. Nozzle 29 is illustrated as being integral to distal end 23 of handle 13; however, nozzle 29 may alternatively be located elsewhere on paint roller assembly 11, as will be described in more detail below. More specifically, nozzle 29 may be located at a myriad of suitable locations on or about handle 13 or frame 15 and may or may not be integral to handle 13 or frame 15. As more clearly seen in FIG. 1B, spray 31 preferably contacts roller sleeve 17 along the entire length of roller sleeve 17 in a substantially tangential orientation with respect to the exterior of roller sleeve 17. Furthermore, spray 31 is illustrated as contacting roller sleeve 17 in a substantially tangential range from the outer surface of inner core 25 to the outermost portions of nap 27.

It should be understood that all of the nozzles disclosed herein could be in the form of inserts that are installed into the handles or other components of the paint roller assemblies. This is particularly true for those embodiments in which the handle is made of relatively soft material for which there would be concern that the shaper of the nozzle might be damaged, or for embodiments that include interchangeable nozzles.

Figure 1D:
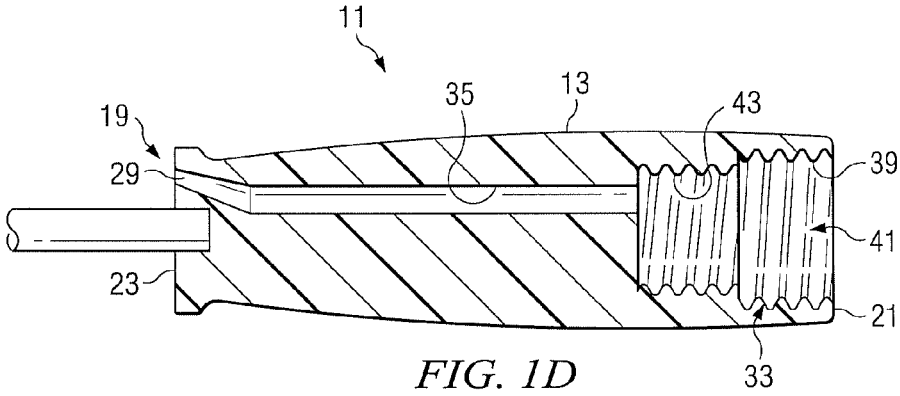
FIG. 1D is a cross-sectional view of the self-cleaning paint roller assembly of FIG. 1A taken at I-I.

Referring specifically to FIG. 1D in the drawings, cleaning means 19 further comprises a fluid tight connector 33 and a fluid conduit 35 for delivering fluid from a fluid source, such as a convention water hose connected to a pressurized water source, to nozzle 29. Of course, fluid tight connector 33, fluid conduit 35, and nozzle 29 are in fluid communication with each other. Connector 33 preferably comprises a first set of internal threads 39, preferably sized and dimensioned to receive a conventional water hose coupling, disposed in a bore 41, or fluid port, on the proximal end 21 of handle 13. Bore 41 optionally comprises a second set of internal threads 43, sized and dimensioned to receive the male threaded end of a conventional paint roller extension handle (not shown).

Although fluid tight connector 33 is illustrated as being female water hose threads 39, fluid tight connector 33 may alternatively be a quick-connect device for connecting to a fluid source, a simple interference fit feature for connecting to a fluid source, or any other suitable fluid tight connection device or feature. Similarly, fluid conduit 35 is illustrated as an elongate cylindrical bore within handle 13 in fluid connection with bore 41 and nozzle 29; however, fluid conduit 35 may alternatively be shaped and located in any other suitable manner while remaining in fluid communication with bore 41 and nozzle 29. For example, fluid conduit 35 may alternatively comprise a substantially coaxial chamber within handle 13 or tubing along the exterior of handle 13.

In operation, a roller sleeve 17 is installed onto roller 16 of paint roller assembly 11, such that nap 27 may be loaded with paint or other material. In preparation for painting, the user may optionally connect a typical paint roller extension handle (not shown) having male threads to handle 13 by screwing the male threads of the extension handle into second set of threads 43. During the painting process, paint roller assembly 11 is used like a conventional paint roller. After painting, it is desirable that any paint or other material not transferred from nap 27 to the item being painted be removed to maintain the quality, texture, and reusable nature of roller sleeve 17. Cleaning means 19 may be used to remove any unused paint or material from roller sleeve 17.

The user implements cleaning means 19 by first removing any paint roller extension handle from second set of threads 43 in handle 13. Next, a source of pressurized cleaning fluid is connected to paint roller assembly 11 at handle 13. In the preferred embodiment, the cleaning fluid is water; however, other cleaning fluids or solvents may be used, depending upon the type of paint or material being cleaned from roller sleeve 17. A conventional water hose having a male fitting is connected to handle 13 by screwing the male threads of the male fitting into first set of threads 39 of bore 41 on the proximal end of handle 13. Next, the user turns on the water. The water travels from the water hose, into bore 41, through fluid conduit 35, and exits through nozzle 29. Because the cross-sectional area of nozzle 29 is less than the cross-sectional area of bore 41, the water exits nozzle 29 at an increased pressure. The rectangular, oblong, or elongated cross-sectional area of nozzle 29 produces fan shaped spray 31.

As the water exits nozzle 29, the water is emitted as fanned fluid spray 31. Because spray 31 contacts roller sleeve 17 in a substantially tangential orientation, roller sleeve 17 begins to spin in the direction of the arrows B in FIGS. 1A and 1B. As roller sleeve 17 spins, paint, matter, and cleaning fluid are slung from the exterior of inner core 25 and any fibers and/or other material of nap 27. After a short time, for example, less than one minute, and preferably less than fifteen seconds, roller sleeve 17 is sufficiently free of paint and/or matter to be stored or used again. The user then discontinues the flow of fluid through the water hose. Finally, the user disconnects handle 13 from the source of cleaning fluid. Of course, the above described steps of operation may be varied to achieve different outcomes and/or objectives.

Referring now to FIGS. 2A-2D in the drawings, an alternate embodiment of a self-cleaning paint roller assembly 111 according to the present invention is illustrated. Paint roller assembly 111 comprises preferably comprises a handle 113, a frame 115 coupled to handle 113, a roller rotatably carried by frame 115, and an integral cleaning means 119. Handle 113 preferably comprises a proximal end 121 and a distal end 123. Cleaning means 119 comprises nozzle 129, a fluid tight connector 133, and a fluid conduit 135 for delivering cleaning fluid from a fluid source (not shown) to nozzle 129. Handle 113 is also illustrated as comprising conventional female paint roller extension handle threads 143. Paint roller assembly 111 differs from paint roller assembly 11 in that paint roller assembly 111 further comprises ergonomic flanges 151 and a valve means 153.

Valve means 153 is illustrated as comprising a rotatable head 155 attached to distal end 123 of handle 113; however, valve means 153 may alternatively be located at any other suitable location on paint roller assembly 111 and constructed in any other suitable manner. As shown clearly in FIG. 2A, head 155 carries nozzle 129 and a portion of fluid conduit 135. Head 155 is adapted to rotate with respect to distal end 123 of handle 113, such that valve means 153 is operable between a first "on" position (see FIG. 2C) in which the portion of fluid conduit 135 carried by head 155 is substantially aligned with and in fluid communication with the portion of fluid conduit 135 carried by handle 113, and a second "off" position (see FIG. 2D) in which the fluid communication is prevented. Of course, valve means 153 may include other intermediate positions, and the various elements of paint roller assembly 111 may be sized, shaped, or constructed in a manner different and that illustrated while remaining within the scope of the present invention.

Paint roller assembly 111 is used and cleaned in the same way as paint roller assembly 11. However, with paint roller assembly 111, the user has the option of turning the water on and off at handle 13. With head 155, the user can control the flow of cleaning fluid being dispensed from nozzle 129 by simply toggling valve means 153 between the "on" and "off" positions.

Figure 3:
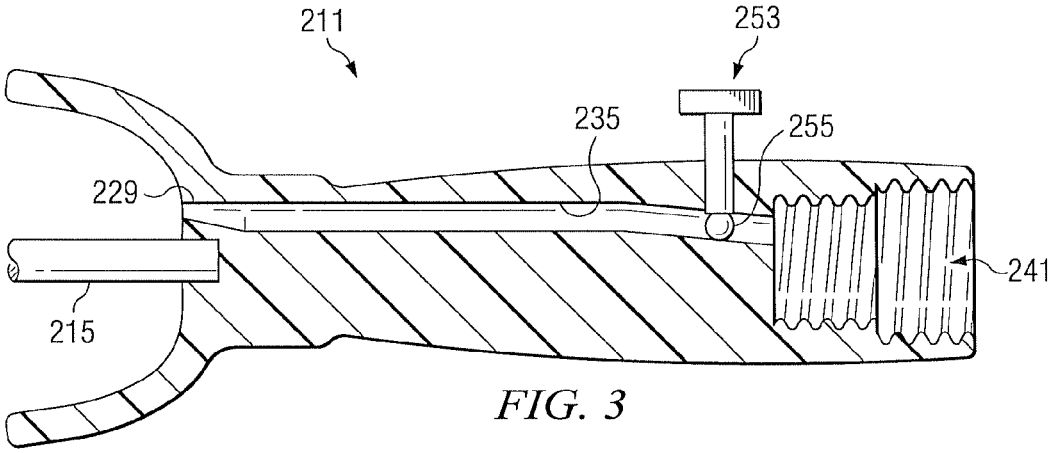
FIG. 3 is a longitudinal cross-sectional view of another alternate embodiment of a self-cleaning paint roller assembly according to the present invention.

Referring now to FIG. 3 in the drawings, another alternate embodiment of a self-cleaning paint roller assembly 211 according to the present invention is illustrated. Paint roller assembly 211 is substantially similar to paint roller assembly 111, but comprising a different valve means 253. As illustrated, valve means 253 comprises a ball valve 255 operably associated with fluid conduit 235. Ball valve 255 may alternatively be associated with bore 241 or nozzle 229. Construction and operation of paint roller assembly 211 are substantially similar to that of paint roller assembly 111, with the exception of valve means 253.

Figure 4:
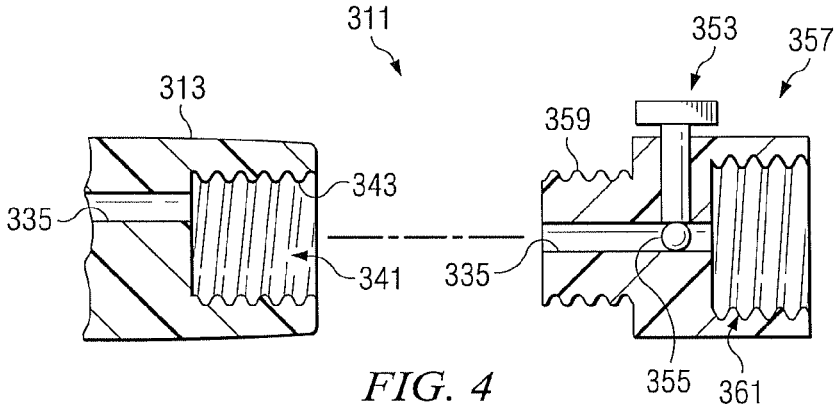
FIG. 4 is a cross-sectional view of another alternate embodiment of a self-cleaning paint roller assembly according to the present invention.

Referring now to FIG. 4 in the drawings, another alternate embodiment of a self-cleaning paint roller assembly 311 according to the present invention is illustrated. Paint roller assembly 311 is substantially similar to paint roller assembly 11; however, paint roller assembly 311 does not comprise an internal set of conventional female water hose threads within handle 313. Instead, paint roller assembly 311 comprises conventional female paint roller extension handle threads 343 within bore 341 and further comprises a fitting 357. Fitting 357 preferably comprises a male connector 359 adapted for insertion into female paint roller extension handle threads 343 and a female connector 361 adapted for receiving the male tip of a conventional water hose. Fitting 357 preferably carries fluid conduit 335 presenting fluid connection between bore 341 and a water hose when properly connected. Fitting 357 may optionally comprise a valve means 353. More specifically, fitting 357 may comprise a ball valve 355 operably associated with fluid conduit 335.

In operation, the cleaning means of paint roller assembly 311 may be connected to a fluid source by inserting male connector 359 into conventional female paint roller extension handle threads 343 within bore 341, inserting the male tip of a conventional water hose into female connector 361, supplying fluid to the water hose, and opening ball valve 355. After operating the cleaning means of paint roller assembly 311, fitting 357 may be disconnected from handle 313 to allow insertion of the male tip of a conventional paint roller extension handle.

Figure 5:
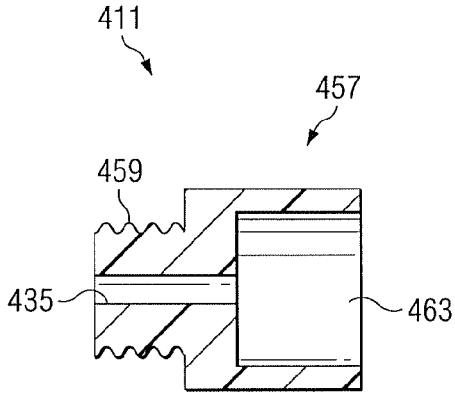
FIG. 5 is a cross-sectional view of another alternate embodiment of a self-cleaning paint roller assembly according to the present invention.

Referring now to FIG. 5 in the drawings, another alternate embodiment of a self-cleaning paint roller assembly 411 according to the present invention is illustrated. Paint roller assembly 411 is substantially similar to paint roller assembly 311; however, fitting 457 does not comprise female connector 361 adapted for receiving the male tip of a conventional water hose. Instead, fitting 457 comprises a substantially smooth-walled receptacle 463 for receiving an end of a polyvinyl-chloride (PVC) pipe, or similar pipe. Fitting 457 preferably comprises a male connector 459 adapted for insertion into female paint roller extension handle threads (not shown) of the handle. Fitting 457 preferably carries fluid conduit 435 presenting fluid connection between the bore (not shown) of the handle (not shown) and a water hose when properly connected. It will be appreciated that fitting 457 may be configured to have internal threads on one end for receiving a paint roller handle and a smooth bore on the other end for receiving a PVC pipe. These configurations may include fluid channels for passing cleaning fluid therethrough, or may be solid. In either case, these configurations allow PVC pipe to be used as extension poles for paint rollers.

For those embodiments in which paint roller assembly 411 is used to dispense cleaning fluid, the cleaning means of paint roller assembly 411 is connected to a fluid source by inserting male connector 459 into conventional female paint roller extension handle threads within the bore of the handle, gluing the PVC pipe into receptacle 463, connecting a conventional water hose to the other end of the PVC pipe, and supplying cleaning fluid to the water hose. After operating the cleaning means of paint roller assembly 411, fitting 457 may be disconnected from the handle. It should be understood that in those applications in which paint roller assembly 411 is not used to pass cleaning fluid, the PVC pipe does not have to be glued into fitting 457.

Figure 6A:
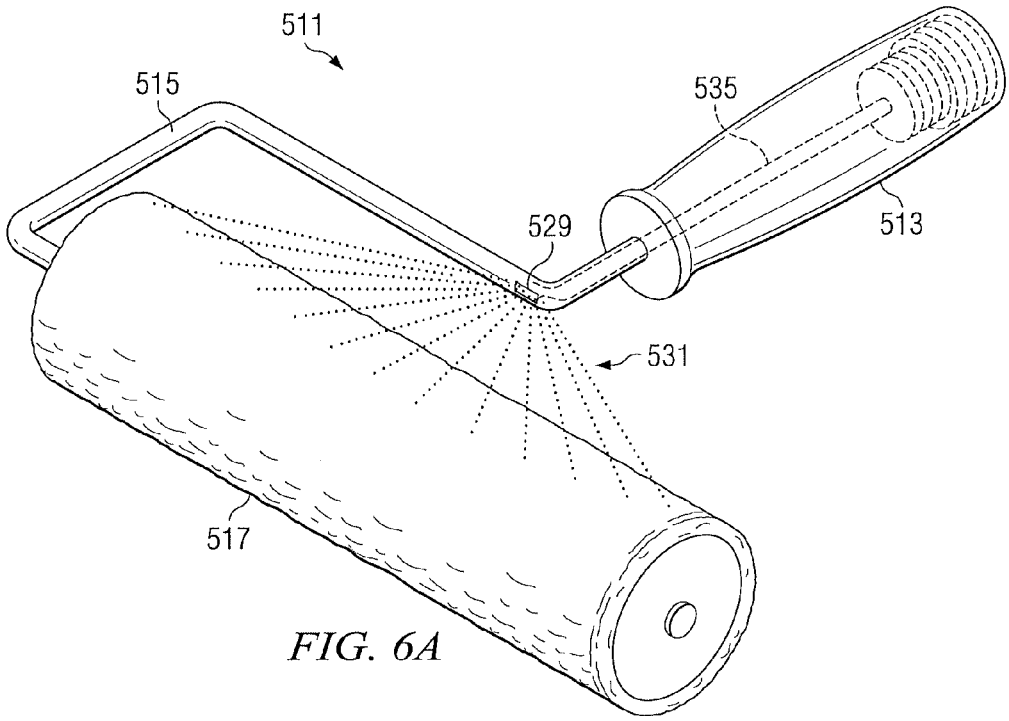
FIGS. 6A-6C are perspective views of another alternate embodiment of a self-cleaning paint roller assembly according to the present invention.
Figure 6B:
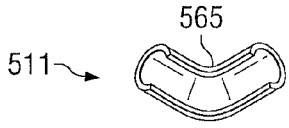
Figure 6C:
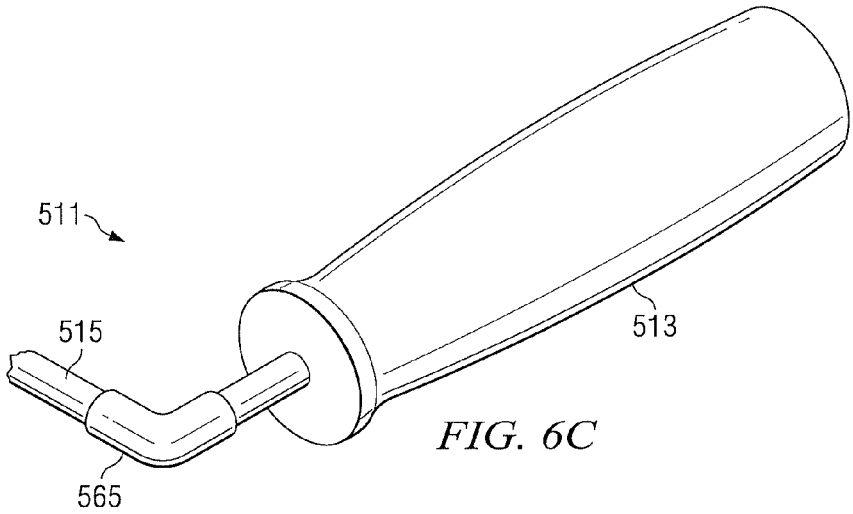

Referring now to FIGS. 6A-6C in the drawings, another alternate embodiment of a self-cleaning paint roller assembly 511 according to the present invention is illustrated. In this embodiment, a nozzle 529 is integral with a frame 515. Nozzle 529 is located near a bend in frame 515. Nozzle 529 is preferably adapted to emit a fluid spray 531 substantially similar to spray 31. Further, spray 531 preferably acts on a roller sleeve 517 in substantially the same manner as spray 31 acts on roller sleeve 17. As illustrated, handle 513 carries the necessary fluid conduit to enable a fluid connection between a water hose and the partially hollow frame 515; however, the necessary fluid connection between nozzle 529 and a fluid source may be achieved in a variety of ways without deviating from the present invention.

Paint roller assembly 511 optionally further comprises a protective shield 565 (see FIG. 6B) adapted for releasable attachment to frame 515. Shield 565 serves to protect nozzle 529 from undesired exposure to paint and other matter while nozzle 529 is not in use. Without shield 565 installed, paint may contact nozzle 529 during painting and later clog or otherwise obstruct the fluid emissions of nozzle 529. Shield 565 is preferably adapted to simply snap onto frame 515 such that nozzle 529 is covered by shield 565 (see FIG. 6C). As illustrated, shield 565 attaches to a bend in frame 515; however, nozzle 529 may alternatively be located elsewhere on frame 515 and shield 565 would correspondingly be adapted to cover the portion of frame 515 which carries the alternatively located nozzle 529.

Figure 7:
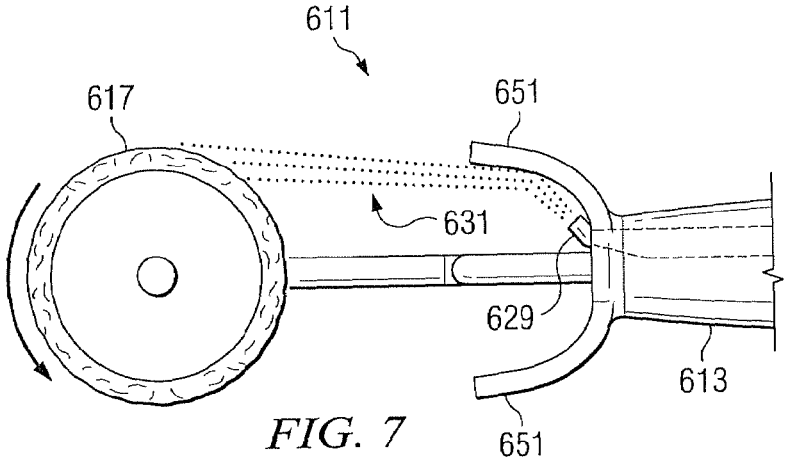
FIG. 7 is a side view of another alternate embodiment of a self-cleaning paint roller assembly according to the present invention.

Referring now to FIG. 7 in the drawings, another alternate embodiment of a self-cleaning paint roller assembly 611 according to the present invention is illustrated. In this embodiment, a nozzle 629 is adapted to emit spray 631 toward or along a flange 651. As illustrated, spray 631 exits nozzle 629, is deflected by flange 651 toward roller sleeve 617, and contacts roller sleeve much in the same manner as spray 31 contacts roller sleeve 17. Spray 631 ultimately contacts roller sleeve 617 such that roller sleeve 617 spins and slings paint, fluid, and other matter from roller sleeve 617. Of course, flanges 651 may be shaped in a myriad of ways to selectively direct the path of spray 631.

Figure 8A:
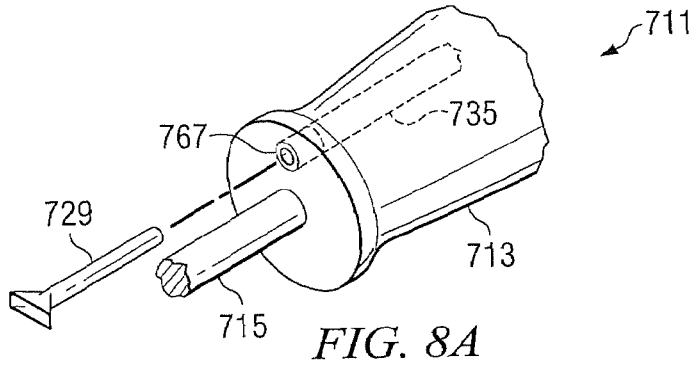
FIG. 8A is an exploded perspective view of another alternate embodiment of a self-cleaning paint roller assembly according to the present invention.
Figure 8B:
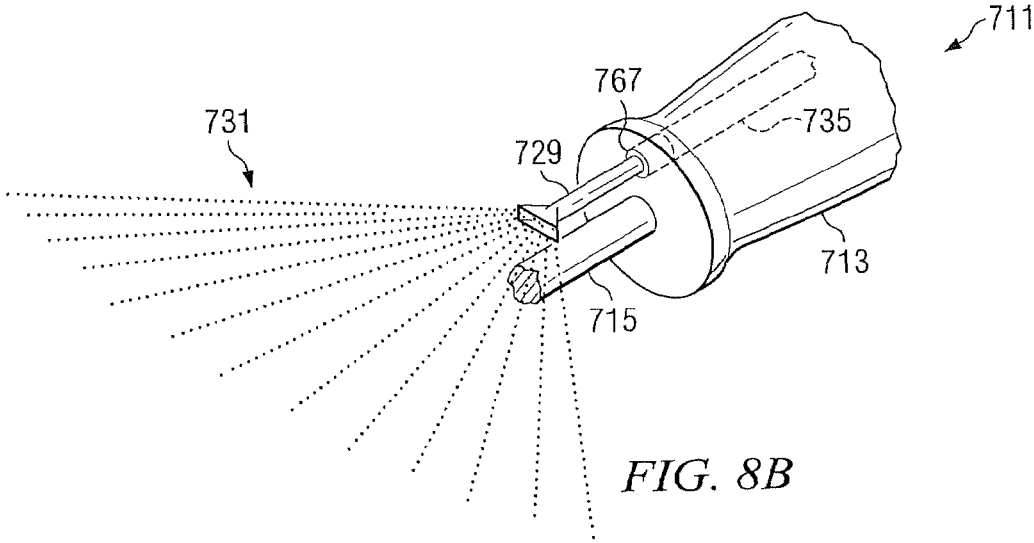
FIG. 8B is an assembled side view of the self-cleaning paint roller assembly of FIG. 8A.

Referring now to FIGS. 8A and 8B in the drawings, another alternate embodiment of a self-cleaning paint roller assembly 711 according to the present invention is illustrated. In this embodiment, a nozzle 729 is removable from a nozzle receptacle 767. As illustrated, handle 713 carries fluid conduit 735 to nozzle receptacle 767. Frame 715 extends from handle 713. Of course, nozzle 729 is adapted for fluid communication with fluid conduit 735 when nozzle 729 is inserted into nozzle receptacle 767. Further, nozzle 729 is adapted to emit spray 731 toward a roller sleeve. Spray 731 ultimately contacts the roller sleeve, such that roller sleeve spins and slings paint, fluid, and other matter from the roller sleeve. Nozzle 729 may be interchangeable with other variously shaped nozzles 729. Thus, a set of nozzles having different spray characteristics may be optionally incorporated into paint roller assembly 711. For example, nozzles may be designed to emit a spray with selected pressures, coverage areas, and flow rates according to the differing cleaning needs associated with differing roller sleeves.

Figure 9A:
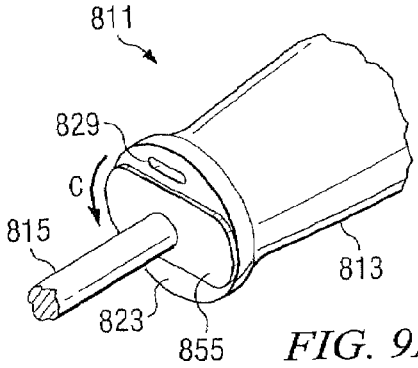
FIGS. 9A-9B are perspective views of another alternate embodiment of a self-cleaning paint roller assembly according to the present invention.
Figure 9B:
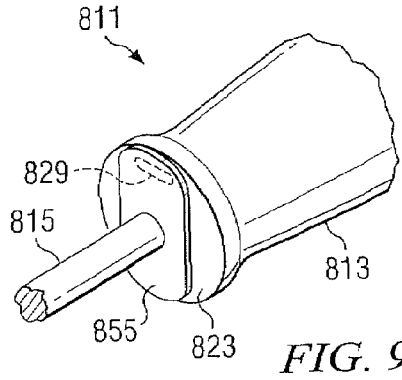

Referring now to FIGS. 9A and 9B in the drawings, another alternate embodiment of a self-cleaning paint roller assembly 811 according to the present invention is illustrated. In this embodiment, a rotatable head 855 serves both as a valve means by obstructing fluid flow through a nozzle 829, and as a means for protecting nozzle 829 from paint and other debris while nozzle 829 is not in use. As illustrated, rotatable head 855 may be a simple substantially oblong plate (carrying no fluid conduit or nozzle) rotatably attached to the distal end 823 of handle 813. Frame 815 is attached to handle 813. Nozzle 829 is illustrated as integral to handle 813. FIG. 9A illustrates rotatable head 855 in a first position where fluid flow from nozzle 829 is unobstructed. FIG. 9B illustrates rotatable head 855 in a second position where fluid flow from nozzle 829 is obstructed by head 855 and nozzle 829 is protected from debris. While head 855 is illustrated as being an oblong plate, it should be appreciated that head 855 may be shaped, sized, and constructed in a myriad of other ways without deviating from the scope of the present invention.

Figure 10:
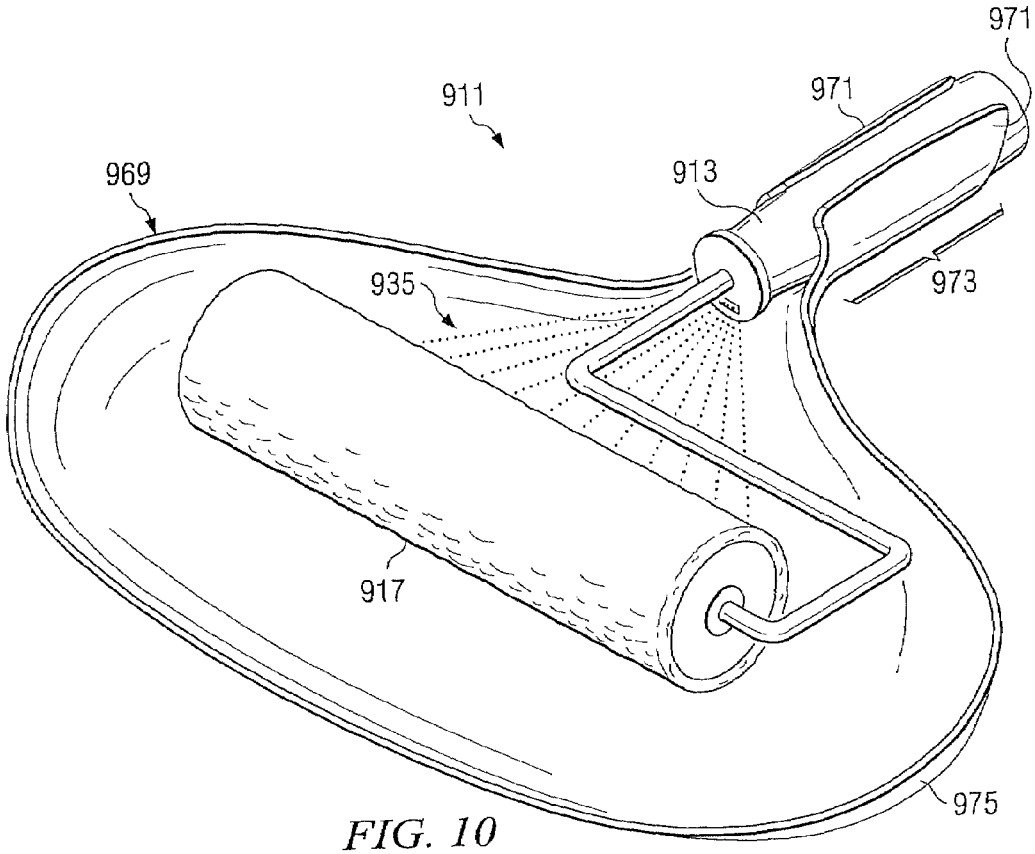
FIG. 10 is a perspective view of another alternate embodiment of a self-cleaning paint roller assembly according to the present invention.

Referring now to FIG. 10 in the drawings, another alternate embodiment of a self-cleaning paint roller assembly 911 according to the present invention is illustrated. This embodiment is substantially similar to paint roller assembly 11, but further comprises a snap-on spray shield 969 for protecting the user from fluids, paint, and matter slung from roller sleeve 917 as well as for aiding the user in directing the runoff of fluid. Shield 969 is illustrated as comprising tabs 971 for removably receiving handle 913 into a handle retention portion 973. Shield 969 is also illustrated as comprising a roller sleeve shroud 975 for containing spray 935 and slung off fluids, matter, and paint while roller sleeve is being cleaned. In operation, the user would snap shield 969 onto handle 913 before cleaning roller sleeve 917 so as to shield himself from the resultant slung fluids, paint, and other matter.

Figure 11:
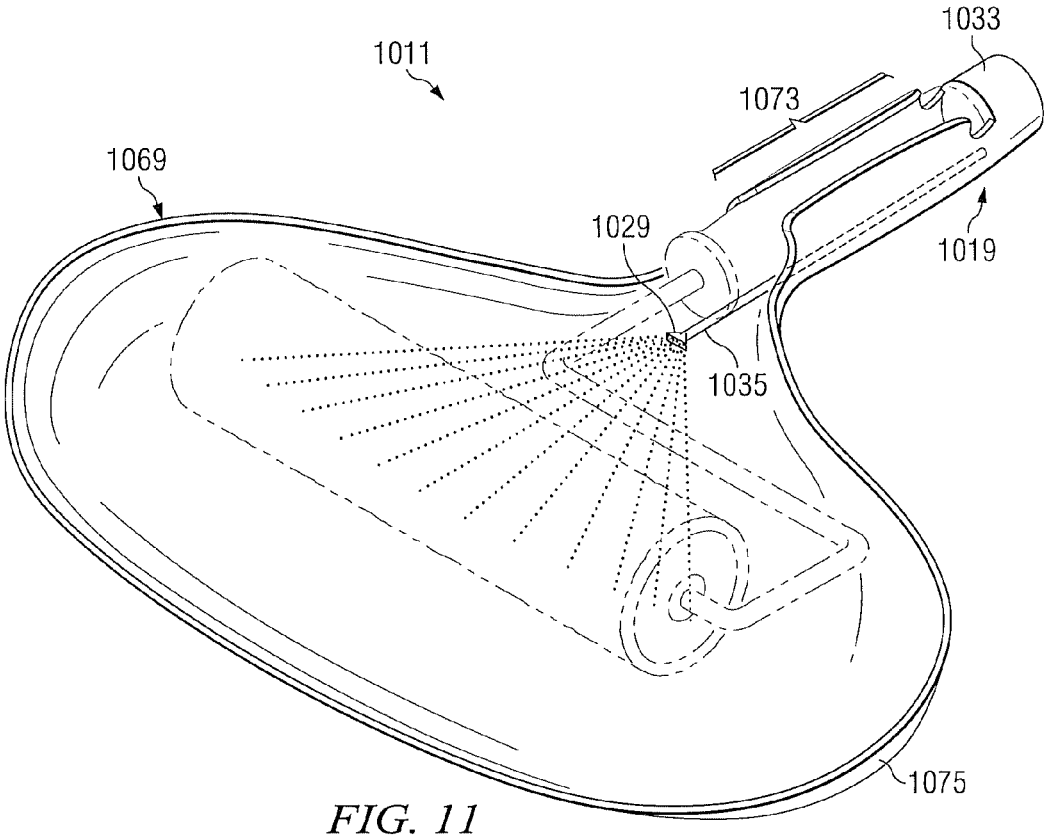
FIG. 11 is a perspective view of another alternate embodiment of a self-cleaning paint roller assembly according to the present invention.

Referring now to FIG. 11 in the drawings, another alternate embodiment of a self-cleaning paint roller assembly 1011 according to the present invention is illustrated. This embodiment is substantially similar to paint roller assembly 911, but further comprises a cleaning means 1019 integrated into shield 1069 for cleaning conventional paint rollers that have no integrated cleaning means. Much like cleaning means 19, cleaning means 1019 comprises a fluid tight connector 1033 for connecting to a conventional water hose, a fluid conduit 1035, and a nozzle 1029. Connector 1033 is illustrated as being located near the handle retention portion 1073; however, connector 1033 may alternatively be located at any other suitable location on or about shield 1069. Further, fluid conduit 1035 is illustrated as tubing; however, fluid conduit 1035 may alternatively be a molded feature or void within the outer walls of shield 1069. Finally, nozzle 1029 is illustrated as a device attached to shroud 1075; however, nozzle 1029 may alternatively be integral to shield 1069 and may be located at any other suitable location on or about shield 1069. In operation, the user would attach a water hose to connector 1033, snap the handle of a conventional paint roller into shield 1069 such that the roller sleeve is located near shroud 1075, and clean the roller sleeve by supplying fluid to the water hose. Of course, nozzle 1029 is adapted to strike roller sleeve in a tangential manner similar to the above described embodiments.

Referring now to FIG. 11 in the drawings, another alternate embodiment of a self-cleaning paint roller assembly 1011 according to the present invention is illustrated. This embodiment is substantially similar to paint roller assembly 911, but further comprises a cleaning means 1019 integrated into shield 1069 for cleaning conventional paint rollers that have no integrated cleaning means. Much like cleaning means 19, cleaning means 1019 comprises a fluid tight connector 1033 for connecting to a conventional water hose, a fluid conduit 1035, and a nozzle 1029. Connector 1033 is illustrated as being located near the handle retention portion 1073; however, connector 1033 may alternatively be located at any other suitable location on or about shield 1069. Further, fluid conduit 1035 is illustrated as tubing; however, fluid conduit 1035 may alternatively be a molded feature or void within the outer walls of shield 1069. Finally, nozzle 1029 is illustrated as a device attached to shroud 1075; however, nozzle 1029 may alternatively be integral to shield 1069 and may be located at any other suitable location on or about shield 1069. In operation, the user would attach a water hose to connector 1033, snap the handle of a conventional paint roller into shield 1069 such that the roller sleeve is located near shroud 1075, and clean the roller sleeve by supplying fluid to the water hose. Of course, nozzle 1029 is adapted to strike roller sleeve in a tangential manner similar to the above described embodiments.

Figure 12:
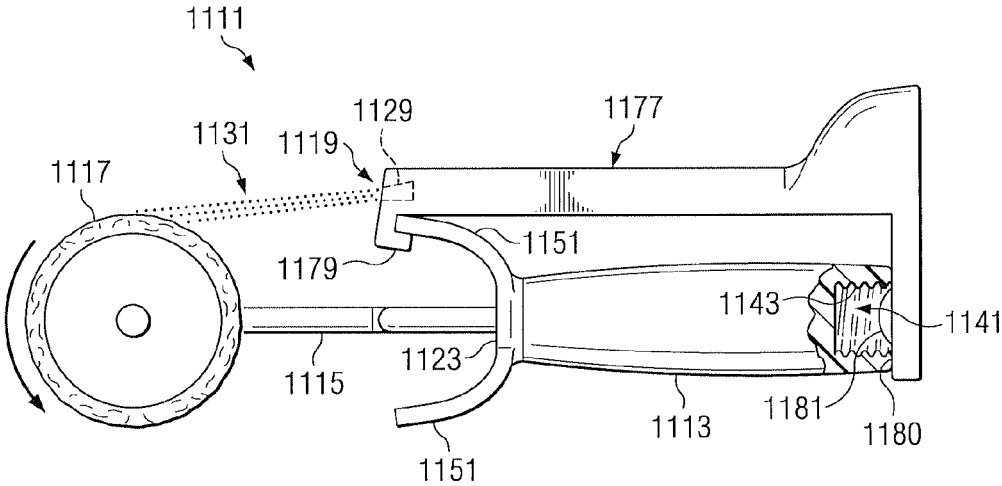
FIG. 12 is an orthographic view of another alternate embodiment of a self-cleaning paint roller assembly according to the present invention.
Figure 13:
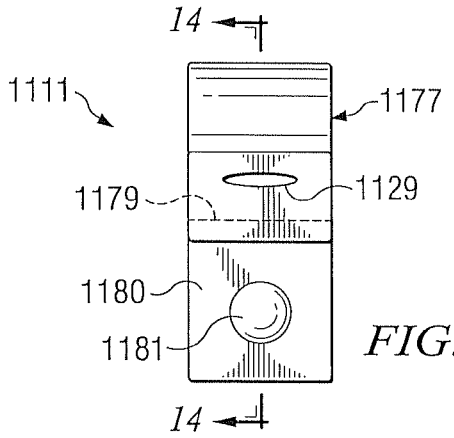
FIG. 13 is a top view of the body of the self-cleaning paint roller assembly according to the present invention.
Figure 14:
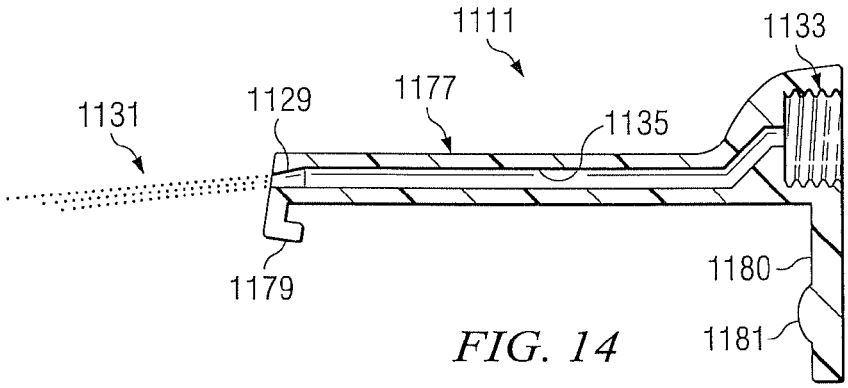
FIG. 14 is a cross-sectional view of the body of FIG. 13.
Figure 15:
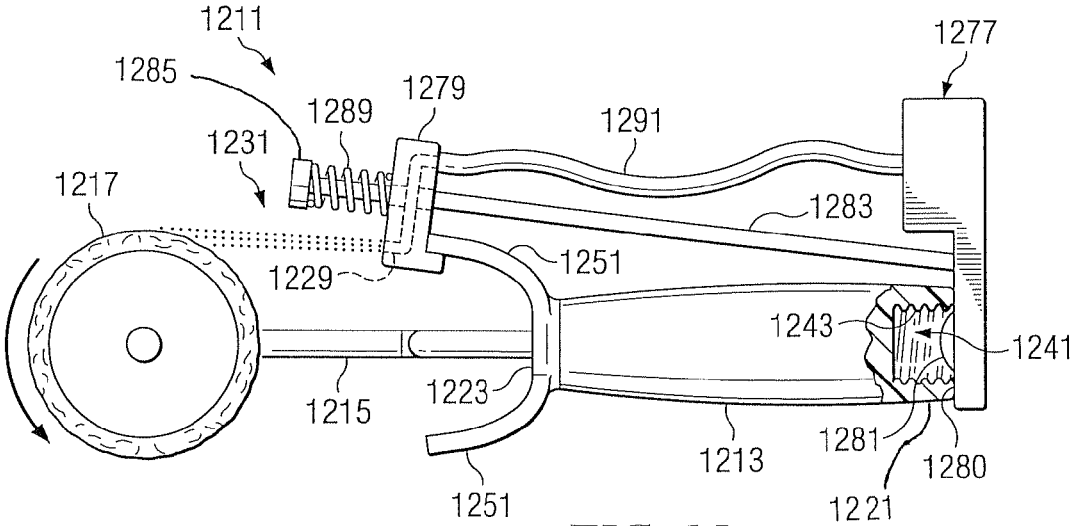
FIG. 15 is an orthographic view of another alternate embodiment of a self-cleaning paint roller assembly according to the present invention.
Figure 16:
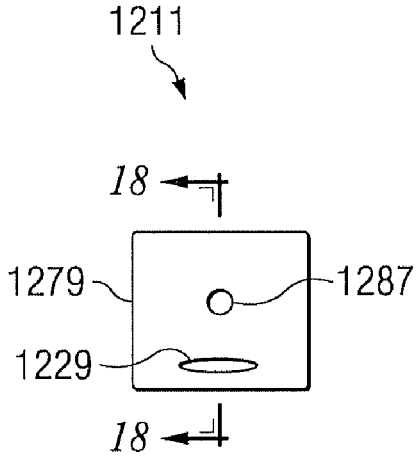
FIG. 16 is a top view of the clamp of the self-cleaning paint roller assembly according to the present invention.
Figure 17:
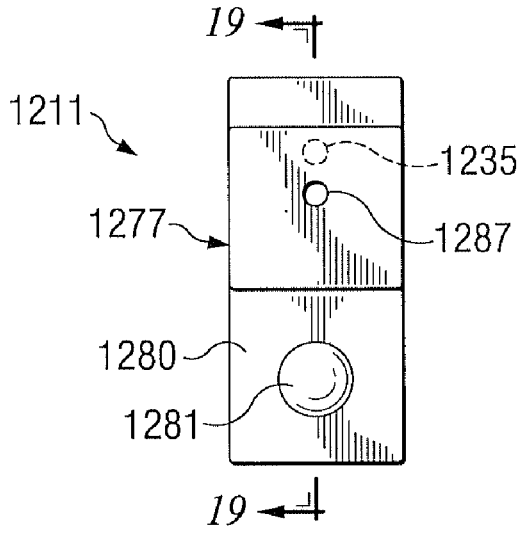
FIG. 17 is a top view of the base of the self-cleaning paint roller assembly according to the present invention.
Figure 18:
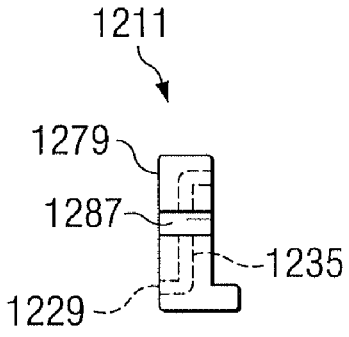
FIG. 18 is a cross-sectional view of the clamp of FIG. 16.
Figure 19:
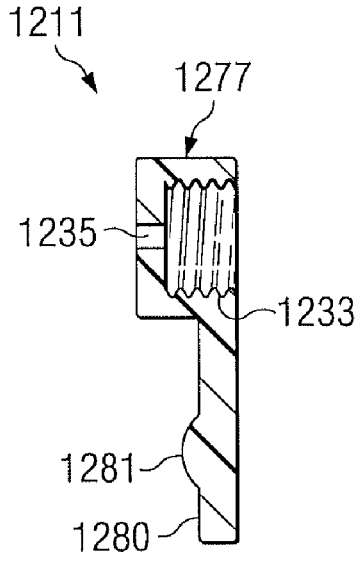
FIG. 19 is a cross-sectional view of the base of FIG. 17.

Referring now to FIGS. 12-14, another alternate embodiment of a self-cleaning paint roller assembly 1111 is illustrated according to the present invention. A conventional paint roller is illustrated has having a handle 1113, a frame 1115, and with a roller sleeve 1117 installed. Handle 1113 is illustrated as having flanges 1151 extending from a distal end 1123 and a bore 1141 lined with conventional female paint roller extension handle threads 1143. A body 1177 is illustrated as being sized and shaped so as to allow removable connection to handle 1113. Body 1177 comprises a hook 1179 for hooking over flange 1151. Body 1177 also has a landing 1180 with a nub 1181 protruding from landing 1180 for snapping into bore 1141. To attach body 1177 to handle 1113, the user first hooks hook 1179 over flange 1151 and then presses body 1177 against handle 1113 to snap nub 1181 into bore 1141. Body 1177 preferably further comprises a cleaning means 1119 for emitting a spray 1131 from a nozzle 1129 (see FIG. 13) onto a roller sleeve 1117. As more clearly illustrated in FIG. 14, body 1177 comprises a fluid tight connector 1133 and a fluid conduit 1135 for providing fluid communication between nozzle 1129 and a fluid source. Connector 1133 is preferably adapted to receive a fitting of a conventional water hose. Of course, a valve means may optionally be incorporated into assembly 1111.

Referring now to FIGS. 15-19, another alternate embodiment of a self-cleaning paint roller assembly 1211 is illustrated according to the present invention. A conventional paint roller is illustrated has having a handle 1213, a frame 1215, and with a roller sleeve 1217 installed. Handle 1213 is illustrated as having flanges 1251 extending from a distal end 1223 and a bore 1241 lined with conventional female paint roller extension handle threads 1243. A hook 1279 is adapted to be hooked over flange 1261. A base 1277 has a landing 1280 with a nub 1281 protruding from landing 1280 for snapping into bore 1241. One end of a guide 1283 is attached to base 1277 while the other end has a stop 1285 attached. Hook 1279 has a hook hole 1287 through which guide 1283 may be inserted. Guide 1283 is passed through hook hole 1287 such that hook 1279 is slidable along guide 1283 between stop 1285 and base 1277. Hook 1279 is spring biased toward base 1277 by a spring 1289. Spring 1289 is disposed along guide 1283 between hook 1279 and stop 1285. To attach hook 1279 and base 1277 to handle 1213, the user first hooks hook 1279 over flange 1251 and then presses pulls base 1277 toward a proximal end 1221 of handle 1213 and snaps nub 1281 into bore 1241. Base 1277 preferably further comprises a portion of a cleaning means for emitting a spray 1231 from a nozzle 1229 (see FIG. 16) onto a roller sleeve 1217. As more clearly illustrated in FIG. 19, base 1277 comprises a fluid tight connector 1233 and a fluid conduit 1235 for providing fluid communication between nozzle 1229 and a fluid source. Hook 1279 carries a fluid conduit 1235 and nozzle 1229. A flexible tube 1291 is used to fluidly connect the fluid conduits 1235 of hook 1279 and base 1277. Connector 1233 is preferably adapted to receive a fitting of a conventional water hose. Of course, a valve means may optionally be incorporated into assembly 1211. While the present invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description.

I claim:

1. A paint roller, comprising:

a handle;

a frame coupled to the handle;

a roller carrier rotatably carried by the frame, the roller carrier being adapted to releasably receive a roller sleeve; and a cleaning means operably associated with the handle for cleaning the roller sleeve, the cleaning means comprising:

only one fan-shaped nozzle offset from the roller sleeve wherein said nozzle includes only one outlet through which cleaning fluid may be dispensed, the nozzle being configured to disperse a cleaning fluid along the length of the roller sleeve.

2. The paint roller according to claim 1, wherein the handle comprises a first set of threads within a bore of the handle and a second set of threads within the bore.

3. The paint roller according to claim 2, wherein the first set of threads is adapted to receive a paint roller extension handle and wherein the second set of threads is adapted to receive a water hose fitting.

4. The paint roller according to claim 1, wherein the cleaning means further comprises:

a fluid port disposed on the handle; and a fluid conduit disposed between the fluid port and the nozzle.

5. The paint roller according to claim 4, further comprising:

a valve means carried by a fitting having a first set of female threads for interfacing a water hose and a second set of male threads for interfacing the handle, the fitting carrying a portion of the fluid conduit such that the water hose is selectively in fluid communication with the nozzle when the fitting is interfaced with the handle.

6. The paint roller according to claim 4, further comprising:

a fitting having a first set of threads for interfacing the handle and a receptacle for interfacing a PVC pipe, the fitting carrying a portion of the fluid conduit such that the PVC pipe is selectively in fluid communication with the nozzle when the fitting is interfaced with the handle.

7. The paint roller according to claim 1, wherein the nozzle is releasably attached to the handle.

8. The paint roller according to claim 1, wherein the nozzle is integral with the handle.

9. The paint roller according to claim 1, wherein the nozzle is carried by the frame.

10. The paint roller according to claim 1, wherein the nozzle is integral with the frame.

11. The paint roller according to claim 1, further comprising:

a valve means for selectively controlling the flow of the cleaning fluid through the nozzle.

12. The paint roller according to claim 11, wherein the valve means comprises:

a movable head attached to the handle, wherein the movable head is operable between a first position in which the cleaning fluid is prevented from exiting the nozzle and a second position in which the cleaning fluid is permitted to exit the nozzle.

13. A paint roller cleaning system, comprising:

a handle;

a frame attached to the handle, the frame being adapted to rotatably carry a roller sleeve;

only one fan-type nozzle operably associated with the handle wherein said nozzle includes only one outlet through which cleaning fluid may be dispensed, the nozzle being adapted to spray fluid along the longitudinal length of the roller sleeve; and two sets of non-overlapping threads disposed in the handle.

14. The paint roller cleaning system according to claim 13, wherein the nozzle is removably attached to the handle.

15. The paint roller cleaning system according to claim 13, further comprising:

a flange attached to the handle, wherein the nozzle is configured and positioned to emit fluid onto the flange, such that the flange directs the emitted fluid to contact the roller sleeve.

16. The paint roller cleaning system according to claim 13, further comprising:

a valve means for selectively controlling the flow of a fluid through the nozzle.

* * * * *